US006962326B2

(12) United States Patent
Else

(10) Patent No.: US 6,962,326 B2
(45) Date of Patent: Nov. 8, 2005

(54) GYPSUM BOARD REMOVER

(76) Inventor: John W. Else, 405 Rustic Cir., Richardson, TX (US) 75080

( * ) Notice: Subject to any disclaimer, the term of this patent is extended or adjusted under 35 U.S.C. 154(b) by 0 days.

(21) Appl. No.: 10/731,952

(22) Filed: Dec. 10, 2003

(65) Prior Publication Data

US 2005/0127339 A1 Jun. 16, 2005

(51) Int. Cl.[7] ..... B66F 15/00
(52) U.S. Cl. ..... 254/25
(58) Field of Search ..... 254/25, 22, 23; 294/86.24, 86.29, 32, 97

(56) References Cited

U.S. PATENT DOCUMENTS 1,492,970 A * 5/1924 Elliott ..... 294/86.24

* cited by examiner

*Primary Examiner*—Robert C. Watson

(74) *Attorney, Agent, or Firm*—W. Thomas Timmons

(57) ABSTRACT

A tool for removing gypsum board according to the present invention includes an elongated handle, a substantially flat extension extending from and attached to one end of the elongated handle, a hinge having a first side and a second side, affixed on the first side to the substantially flat extension and a pry flap affixed to the second side of the hinge. The pry flap will fold against the substantially flat extension when the tool is being pushed through the gypsum board, and a stop for holding the pry flap away from the substantially flat extension when the tool is being pulled back through the gypsum board. The stop holds the pry flap at approximately 80 degrees or substantially a right angle to the substantially flat extension and the pry flap is substantially the same width as the substantially flat extension. In one form, the stop forms a sharp angle with the end of the substantially flat extension opposite the elongated handle, forming a wedge for breaking through the gypsum board. In one form, the tool for removing gypsum board also includes a substantially flat stub out affixed at an angle to the substantially flat extension on the side of the substantially flat extension opposite the pry flap and substantially closer to the elongated handle than the pry flap.

13 Claims, 1 Drawing Sheet

GYPSUM BOARD REMOVER

BACKGROUND OF THE INVENTION

1. Field of the Invention

The present invention relates generally to wrecking tools and to tools used by firefighters, and more particularly to tools used for removing gypsum board.

2. Description of Related Art

Gypsum board, also known as Sheetrock or drywall, is a common material used to cover structural components in most residential and many commercial applications. Firefighters regularly must remove this material to access voids, attics and unoccupied areas. Firefighters frequently have used pike poles, as used on fishing boats, to poke holes in the gypsum board and whittle away at it in order to make a hole large enough for access to suspected fire areas.

SUMMARY OF THE INVENTION

A tool for removing gypsum board according to the present invention includes an elongated handle, a substantially flat extension extending from and attached to one end of the elongated handle, a hinge having a first side and a second side, affixed on the first side to the substantially flat extension, a pry flap affixed to the second side of the hinge, wherein the pry flap will fold against the substantially flat extension when the tool is being pushed through the gypsum board, and a stop for holding the pry flap away from the substantially flat extension when the tool is being pulled back through the gypsum board. In a preferred form, the stop holds the pry flap at approximately 80 degrees or substantially a right angle to the substantially flat extension and the pry flap is substantially the same width as the substantially flat extension.

In a preferred arrangement, the stop forms a sharp angle with the end of the substantially flat extension opposite the elongated handle, forming a wedge for breaking through the gypsum board.

In one form, the tool for removing gypsum board also includes a substantially flat stub out affixed at an angle to the substantially flat extension on the side of the substantially flat extension opposite the pry flap and substantially closer to the elongated handle than the pry flap.

These and other objects, advantages and features of this invention will be apparent from the following description taken with reference to the accompanying drawing, wherein is shown a preferred embodiment of the invention.

DESCRIPTION OF THE PREFERRED EMBODIMENT

Figure 1:
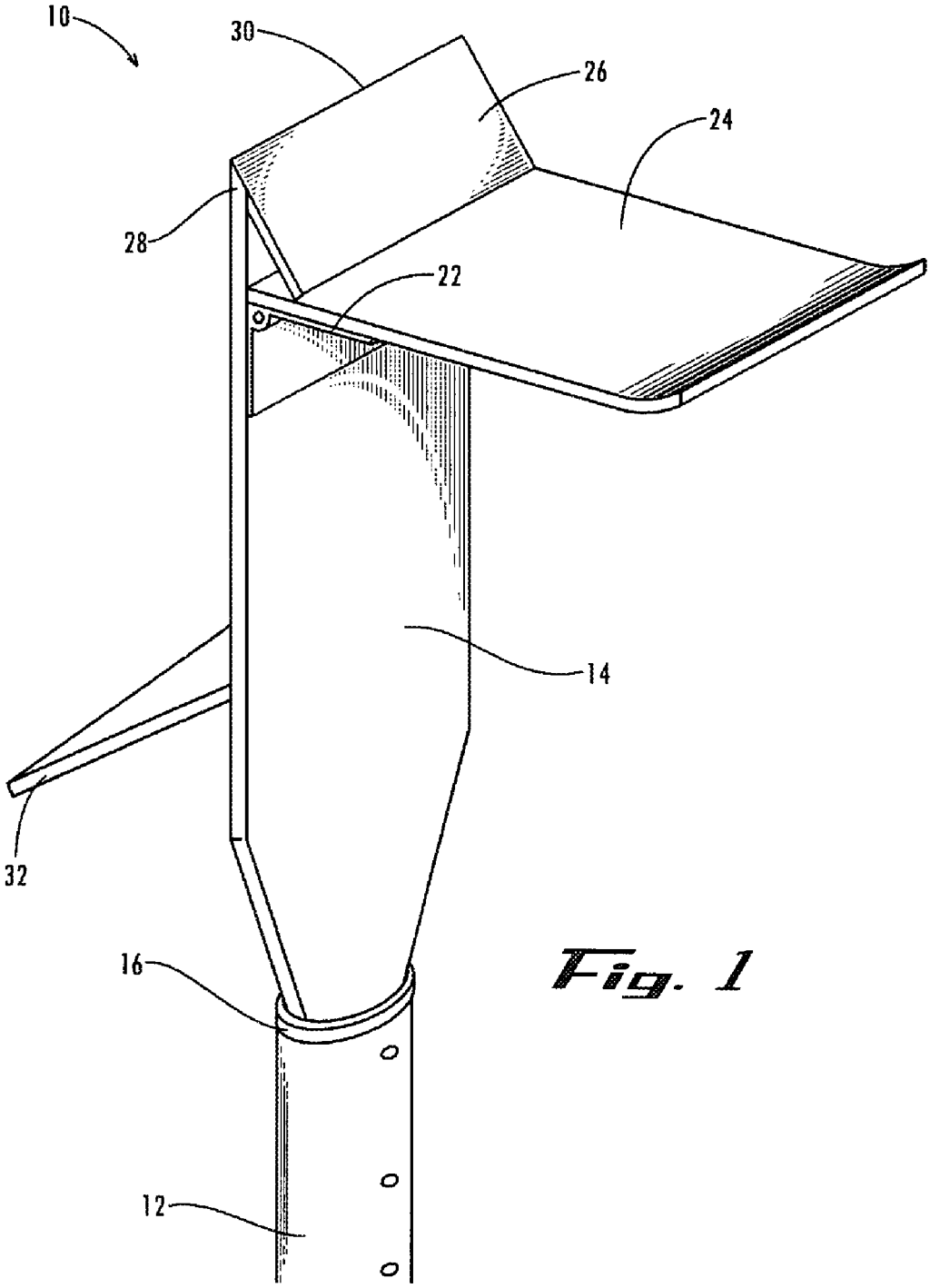
FIG. 1 is a perspective view of a tool according to the present invention.

Referring now to the drawing, and in particular to FIG. 1, a tool for removing gypsum board according to the present invention is referred to generally by reference numeral 10. Tool 10 includes an elongated handle 12, a substantially flat extension 14 extending from and attached to one end 16 of the elongated handle, a hinge 18 having a first side 20 and a second side 22, affixed on the first side to the substantially flat extension, a pry flap 24 affixed to the second side 22 of the hinge, wherein the pry flap will fold against the substantially flat extension when the tool is being pushed through the gypsum board, and a stop 26 for holding the pry flap away from the substantially flat extension when the tool is being pulled back through the gypsum board. In a preferred form, the stop holds the pry flap at approximately 80 degrees or substantially a right angle to the substantially flat extension and the pry flap is substantially the same width as the substantially flat extension.

In a preferred arrangement, the stop forms a sharp angle 28 with the end of the substantially flat extension opposite the elongated handle, forming a wedge 30 for breaking through the gypsum board.

In one form, the tool for removing gypsum board also includes a substantially flat stub out 32 affixed at an angle of approximately 80 degrees to the substantially flat extension on the side of the substantially flat extension opposite the pry flap and substantially closer to the elongated handle than the pry flap.

From the foregoing it will be seen that this invention is well adapted to attain all of the ends and objectives hereinabove set forth, together with other advantages which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the figures of the accompanying drawings is to be interpreted as illustrative and not in a limiting sense.

What is claimed is:

1. A tool for removing gypsum board, comprising in combination:

an elongated handle;

a substantially flat extension extending from and attached to one end of the elongated handle;

a hinge having a first side and a second side, affixed on the first side to the substantially flat extension;

a pry flap affixed to the second side of the hinge, wherein the pry flap will fold against the substantially flat extension when the tool is being pushed through the gypsum board; and a stop for holding the pry flap away from the substantially flat extension when the tool is being pulled back through the gypsum board.

2. A tool for removing gypsum board according to claim 1 one wherein the stop holds the pry flap at approximately 80 degrees or substantially a right angle to the substantially flat extension.

3. A tool for removing gypsum board according to claim 2, wherein the pry flap is substantially the same width as the substantially flat extension.

4. A tool for removing gypsum board according to claim 3, wherein the stop forms a sharp angle with the end of the substantially flat extension opposite the elongated handle, wherein the combination substantially flat extension with the stop form a wedge for breaking through the gypsum board.

5. A tool for removing gypsum board according to claim 4 further comprising a substantially flat stub out affixed at an angle to the substantially flat extension on the side of the substantially flat extension opposite the pry flap and substantially closer to the elongated handle than the pry flap.

6. A tool for removing gypsum board according to claim 1, wherein the pry flap is substantially the same width as the substantially flat extension.

7. A tool for removing gypsum board according to claim 6, wherein the stop forms a sharp angle with the end of the substantially flat extension opposite the elongated handle, wherein the combination substantially flat extension with the stop form a wedge for breaking through the gypsum board.

8. A tool for removing gypsum board according to claim 7 further comprising a substantially flat stub out affixed at an angle to the substantially flat extension on the side of the substantially flat extension opposite the pry flap and substantially closer to the elongated handle than the pry flap.

9. A tool for removing gypsum board according to claim 1, wherein the stop forms a sharp angle with the end of the substantially flat extension opposite the elongated handle, wherein the combination substantially flat extension with the stop form a wedge for breaking through the gypsum board.

10. A tool for removing gypsum board, comprising in combination:

an elongated handle;

a substantially flat extension extending from and attached to one end of the elongated handle;

a pry flap hingedly affixed to the substantially flat extension, wherein the pry flap will fold against the substantially flat extension when the tool is being pushed through the gypsum board; and a stop for holding the pry flap away from the substantially flat extension when the tool is being pulled back through the gypsum board, wherein the stop holds the pry flap at approximately 80 degrees or substantially a right angle to the substantially flat extension, and wherein the pry flap is substantially the same width as the substantially flat extension, and wherein the stop forms a sharp angle with the end of the substantially flat extension opposite the elongated handle, wherein the combination substantially flat extension with the stop form a wedge for breaking through the gypsum board.

11. A tool for removing gypsum board according to claim 10 further comprising a substantially flat stub out affixed at an angle to the substantially flat extension on the side of the substantially flat extension opposite the pry flap and substantially closer to the elongated handle than the pry flap.

12. A tool for removing gypsum board, comprising in combination:

an elongated handle;

a substantially flat extension extending from and attached to one end of the elongated handle;

a pry flap hingedly affixed to the substantially flat extension, wherein the pry flap will fold against the substantially flat extension when the tool is being pushed through the gypsum board; and a stop for holding the pry flap away from the substantially flat extension when the tool is being pulled back through the gypsum board wherein the pry flap is substantially the same width as the substantially flat extension and wherein the stop forms a sharp angle with the end of the substantially flat extension opposite the elongated handle, wherein the combination substantially flat extension with the stop form a wedge for breaking through the gypsum board.

13. A tool for removing gypsum board according to claim 12 further comprising a substantially flat stub out affixed at an angle to the substantially flat extension on the side of the substantially flat extension opposite the pry flap and substantially closer to the elongated handle than the pry flap.

* * * * *